US006315154B1

(12) United States Patent
Newby, Sr.

(10) Patent No.: US 6,315,154 B1
(45) Date of Patent: Nov. 13, 2001

(54) DOUBLE-WALL BLOW-MOLDED ARTICLE WITH PINNED HINGE

(75) Inventor: J. Parks Newby, Sr., Raleigh, NC (US)

(73) Assignee: Delta Consolidated Industries, Raleigh, NC (US)

( * ) Notice: Subject to any disclaimer, the term of this patent is extended or adjusted under 35 U.S.C. 154(b) by 0 days.

(21) Appl. No.: 09/525,813

(22) Filed: Mar. 15, 2000

(51) Int. Cl.[7] ..... B65D 43/14

(52) U.S. Cl. ..... 220/844; 220/843; 220/4.23; 16/380

(58) Field of Search ..... 16/380, 381; 220/4.22, 220/4.23, 843, 844; 264/575, 523, 238; 425/522; 29/525.01

(56) References Cited

U.S. PATENT DOCUMENTS

| | | | | |
|---|---|---|---|---|
| 583,629 | | 6/1897 | Oldenbusch . | |
| 730,876 | * | 6/1903 | Christ | 16/381 |
| 1,030,801 | * | 6/1912 | Berault | 16/380 |
| 2,012,800 | | 8/1935 | Allen . | |
| 2,154,860 | * | 4/1939 | Morse | 16/381 |
| 2,200,399 | | 5/1940 | Primas . | |
| 2,766,901 | | 10/1956 | Sunko . | |
| 2,772,441 | * | 12/1956 | Riser | 16/381 |
| 2,997,734 | * | 8/1961 | Dyer | 16/381 |
| 3,126,120 | * | 3/1964 | Crate | 220/844 |
| 3,188,686 | * | 6/1965 | Orcutt | 16/381 |
| 3,593,365 | * | 7/1971 | Amundsen | 16/380 |
| 3,803,668 | | 4/1974 | Remick . | |
| 3,828,969 | | 8/1974 | Schurman . | |
| 3,902,628 | | 9/1975 | Schurman . | |
| 3,991,905 | | 11/1976 | Nicpon . | |
| 4,175,315 | * | 11/1979 | Hayes, Sr. et al. | 16/380 |
| 4,201,531 | * | 5/1980 | Schurman | 425/525 |
| 4,358,871 | | 11/1982 | Takai . | |
| 4,486,164 | * | 12/1984 | Wilkie et al. | 425/525 |
| 4,486,379 | * | 12/1984 | Wilkie et al. | 264/523 X |
| 4,522,312 | * | 6/1985 | Ratheber et al. | 220/324 |
| 4,615,464 | | 10/1986 | Byrns . | |
| 4,623,071 | * | 11/1986 | Malcolm | 220/4.22 X |
| 4,648,834 | * | 3/1987 | Von Holdt . | |
| 4,930,753 | | 6/1990 | Alvyn . | |
| 5,288,453 | | 2/1994 | Rutenbeck et al. . | |
| 5,361,456 | * | 11/1994 | Newby, Sr. . | |
| 5,666,695 | * | 9/1997 | Jergers et al. | 16/381 |
| 5,711,053 | * | 1/1998 | Hafner | 16/380 |
| 6,012,714 | * | 1/2000 | Worley et al. . | |

* cited by examiner

*Primary Examiner*—Allan N. Shoap
*Assistant Examiner*—Robin A. Hylton
(74) *Attorney, Agent, or Firm*—Myers Bigel Sibley & Sajovec

(57) ABSTRACT

A hinge configuration includes: a first member having a plurality of hinge fingers with partially cylindrical surfaces, wherein at least one of these surfaces is upwardly facing and at least one of these surfaces is downwardly facing, and wherein the hinge fingers are spaced apart along an axis of rotation and the surfaces of the hinge fingers are radially aligned along the axis of rotation; a second member having a plurality of hinge fingers with partially cylindrical surfaces, wherein at least one of these surfaces is upwardly facing and at least one of these surfaces is downwardly facing, and wherein the hinge fingers are spaced apart along the axis of rotation and the surfaces of the hinge fingers are radially aligned along the axis of rotation; and a pin including a shaft extending along the axis of rotation, an end head at one end of the shaft, and an intermediate head spaced apart from the end head and extending radially from the shaft. The shaft is in contact with and rotatable relative to the surfaces of the hinge fingers of the first and second members. One of the surfaces of the first member hinge fingers or the second member hinge fingers includes a recess that receives the intermediate head of the pin. In this configuration, the pin can be retained in the hinge fingers, thereby eliminating the need for an interference fit between the pin and the hinge fingers.

17 Claims, 5 Drawing Sheets

DOUBLE-WALL BLOW-MOLDED ARTICLE WITH PINNED HINGE

FIELD OF THE INVENTION

This invention relates generally to hinged articles, and relates more specifically to double-wall blow-molded hinged articles.

BACKGROUND OF THE INVENTION

Blow-molding is a well-known fabrication method for thermoplastic components. The process generally involves the molding of a hollow tube, or "parison," of molten thermoplastic that is lowered from an overhanging extrusion head to a position between halves of a reciprocating mold. As the mold halves close, air or some other gas is injected into the parison; the increased air pressure within the parison caused by such injection forces the parison walls into the contours of the cavities of the mold halves, thus forming the parison into a desired molded shape. The resulting component has molded walls that surround a hollow chamber. Blow-molding has proven to be particularly popular for the production of large parts that would require unduly large molding injection molding machines.

One type of blow-molding that has been used successfully for large components that require structural rigidity is the so-called "double-wall" blow-molding process. In this process, mold halves are most often designed as distinct core and cavity halves (rather than as two cavities, as would be the case for single-wall blow-molded articles, such as bottles or other containers). The core portion of the core mold half extends within the cavity as the mold halves close. In addition, the mold halves for double-wall components are configured so that the molded components have "full-perimeter flash"; i.e., after molding the component has excess material, or "flash", around the perimeter defined by mating surfaces of the mold halves. This contrasts with single-wall components, in which the parison is inflated entirely within closed mold cavities, and the molded component typically has flash only on its top and bottom portions. Double-wall blow-molded components have distinct inner and outer walls that surround a hollow space, with the inner wall having been formed by the core and the outer wall having been formed by the cavity, and with the inner and outer walls being separated by the weld line remaining after the flash is removed. In a typical double-wall component the inner and outer walls are positioned proximate to one another and can have "pinched-off" areas, in which the inner and outer walls are contiguous.

One distinct advantage provided by double-wall blow-molded components is the capability for adjacent regions of the inner and outer walls to differ significantly in their localized contour. For example, a region of the outer wall may have a relatively flat profile, while the adjacent region of the inner wall can contain numerous projections, recesses, and the like, with the profile of either localized region failing to impact significantly the appearance or structural integrity of the other. Such differences in localized inner and outer wall contour are less likely to be successfully achieved in injection-molded components because the inclusion of substantial detail in the inner wall can have a deleterious effect on the dimensional stability, appearance, and even strength of the outer wall. Another performance advantage conveyed by double-wall components stems from the formation of the hollow chamber within the inner and outer walls, as it can provide an air cushion that protects items contacting the inner wall.

For these reasons, double-wall blow-molded components have proven to be particularly popular for protective containers and carrying cases. Detailed contour that mates with, matches, supports, or captures portions of an item to be carried within the carrying case can be included in the inner wall of the double-wall component even as the outer wall has a generally flat, appearance-sensitive surface. Further, the air cushion between the inner and outer walls helps to protect the item. Thus, the container can have the detail and structure necessary to support, transport and protect the item while providing the desired aesthetic appeal, and can do so without the manufacturer having to produce two separate parts for the inner and outer walls.

A typical carrying case includes two components (ordinarily a container and a lid) that are pivotally interconnected along one edge to enable the lid to open and close. It is preferred that much of the structure that forms the hinge for these components be molded into the lid and container. Some hinges employ only structures that are molded into the lid and container (see, for example, U.S. Pat. No. 5,361,456 to Newby, Sr., which employs a molded-in post and receptacle design), while other hinge configurations include one or more additional components.

One popular hinge configuration that includes an additional component besides the lid and container is the "pinned hinge" design, in which an elongate pin is inserted into hollow cylindrical or semicylindrical structures located on the lid and container. These structures of the lid and container hold the pin in place, but are free to rotate about the pin, which in turn allows the lid to pivot relative to the container. Pinned hinge designs generally exhibit good strength, particularly because the material of the pin can differ (and accordingly, can be stronger than) from the material of the lid and container structures. Examples of pinned hinge designs are illustrated in U.S. Pat. No. 4,615,464 to Byrns (which involves a separate step of drilling a hole for the pin after molding), and U.S. Pat. No. 5,208,453 to Rutenbeck et al. (which employs a pin insert that is molded into the hinge during molding).

One issue of pinned hinge designs of the type noted above involves retaining the pin in position. In order to maintain the pin in position, the hinge structures of the lid and container form a slight "interference" fit with the pin. The interference fit between the pin and the hinge structures can undesirably increase frictional resistance to rotation. Also, over long-term use, the plastic forming the hinge structures can "creep" (i.e., slowly flow over time to reduce the hoop stress caused by the interference fit), which can also reduce the ability of the hinge structures to maintain the pin in position. Further, designs that utilize a fully cylindrical structure to capture the pin must either be formed during molding by a "side-action" mechanism or a mold insert (either of which can complicate the molding process and/or increase the cost of the mold), or must be formed in a secondary operation (such as post-molding drilling).

SUMMARY OF THE INVENTION

In view of the foregoing, it is an object of the present invention to provide a pinned hinge configuration that enables an interference-fit pin to be avoided.

It is also an object of the present invention to provide a pinned hinge configuration that reduces the tendency of a pin to loosen within the hinge due to creep undergone by hinge structures.

It is a further object of the present invention to provide a pinned hinge configuration that does not require a "side-action" mechanism in the mold or a post-molding operation to form the receptacles for the pins.

These and other objects are satisfied by the present inventions which is directed to a hinge configuration. The hinge configuration of the present invention comprises: a first member having a plurality of hinge fingers with partially cylindrical surfaces, wherein at least one of these surfaces is upwardly facing and at least one of these surfaces is downwardly facing, and wherein the hinge fingers are spaced apart along an axis of rotation and the surfaces of the hinge fingers are radially aligned along the axis of rotation; a second member having a plurality of hinge fingers with partially cylindrical surfaces, wherein at least one of these surfaces is upwardly facing and at least one of these surfaces is downwardly facing, and wherein the hinge fingers are spaced apart along the axis of rotation and the surfaces of the hinge fingers are radially aligned the axis of rotation; and a pin including a shaft extending along the axis of rotation, an end head at one end of the shaft, and an intermediate head spaced apart from the end head and extending radially from the shaft. The shaft is in contact with and rotatable relative to the surfaces of the hinge fingers of the first and second members. One of the surfaces of the first member hinge fingers or the second member hinge fingers includes a recess that receives the intermediate head of the pin. In this configuration, the pin can be retained in the hinge fingers, thereby eliminating the need for an interference fit between the pin and the hinge fingers. Also, this configuration can be molded without the need for either side-action mechanisms in the mold or separate pin inserts.

In one embodiment, the first and second members of the hinge configuration are the container and the lid of a carrying case. In such an embodiment, it is preferred that the lid and container be formed of a polymeric material and in a double-wail blow-molding process. It is also preferred that the recess be located in an endmost hinge finger, and that the hinge fingers of the first and second members be interdigitated when the pin is in position.

DETAILED DESCRIPTION OF THE INVENTION

The present invention now will be described more fully hereinafter with reference to the accompanying drawings, in which preferred embodiments of the invention are shown and described. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like components throughout.

Figure 1:
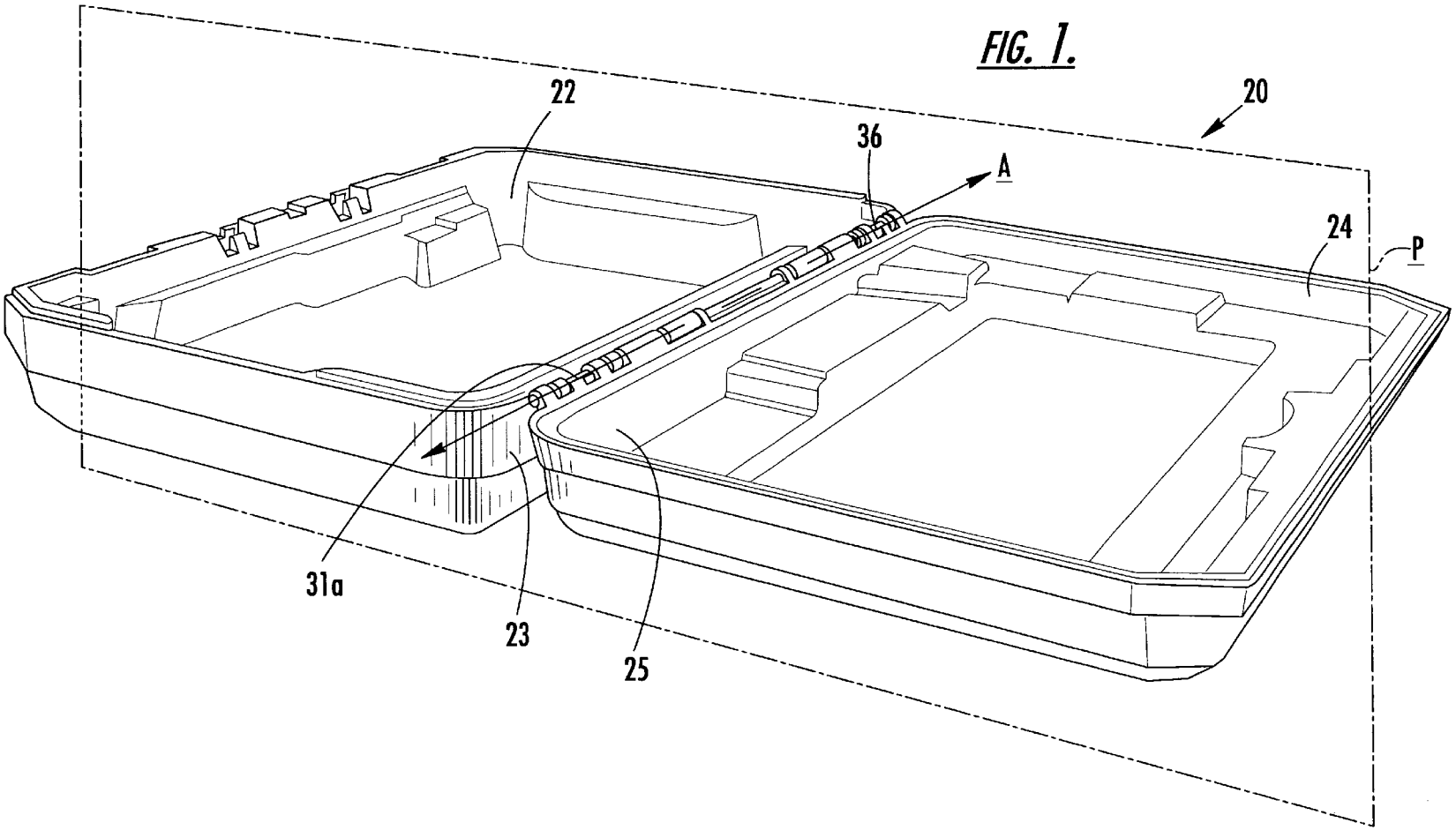
FIG. 1 is a perspective view of a double-walled blow-molded carrying case of the present invention with the lid in the open position.

Referring now to the drawings, a carrying case, designated broadly at 20, is illustrated in FIG. 1. The carrying case 20 includes a container 22 having a rear wall 23 and a lid 24 having a rear wall 25. The lid 24 is pivotally interconnected with the container 22 at a hinge 30 located on the rear walls 23, 25 such that the lid 24 can pivot about an axis of rotation A relative to the container 22. When the lid 24 is in its closed position (as shown in phantom line in FIG. 2), the carrying case 20 thus has a container cavity (not shown) that is configured to contain, transport, and protect a power tool, such as a power drill. Those skilled in this art will appreciate that a carrying case of the present invention can take a variety of configurations and protect any number of items, such as electronic, computer, video, or camera equipment, sales samples, and the like.

Figure 2:
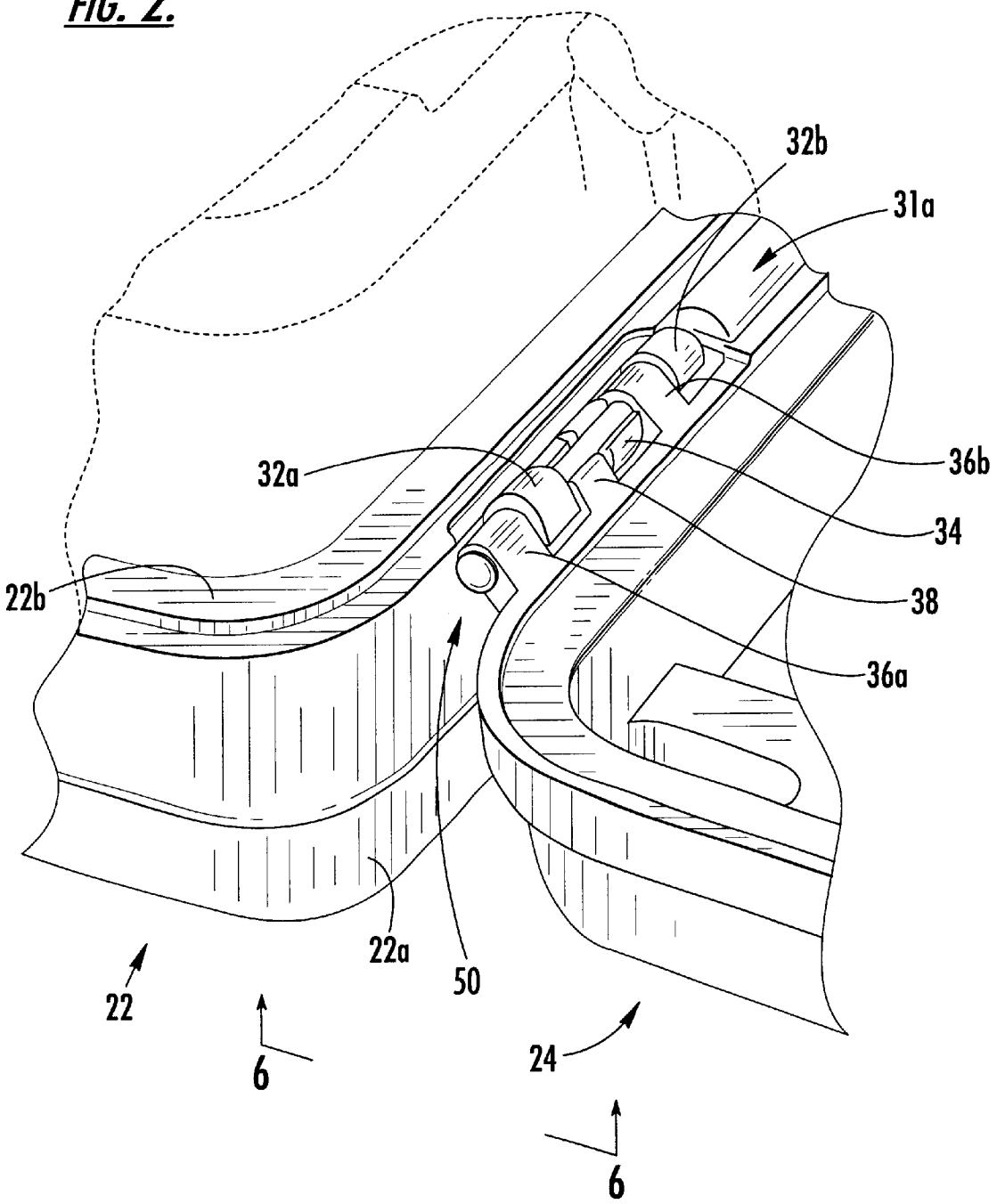
FIG. 2 is an enlarged partial perspective view of the carrying case of FIG. 1 illustrating one hinge unit with the lid in its open position (the lid is shown in its closed position in phantom line).
Figure 3:
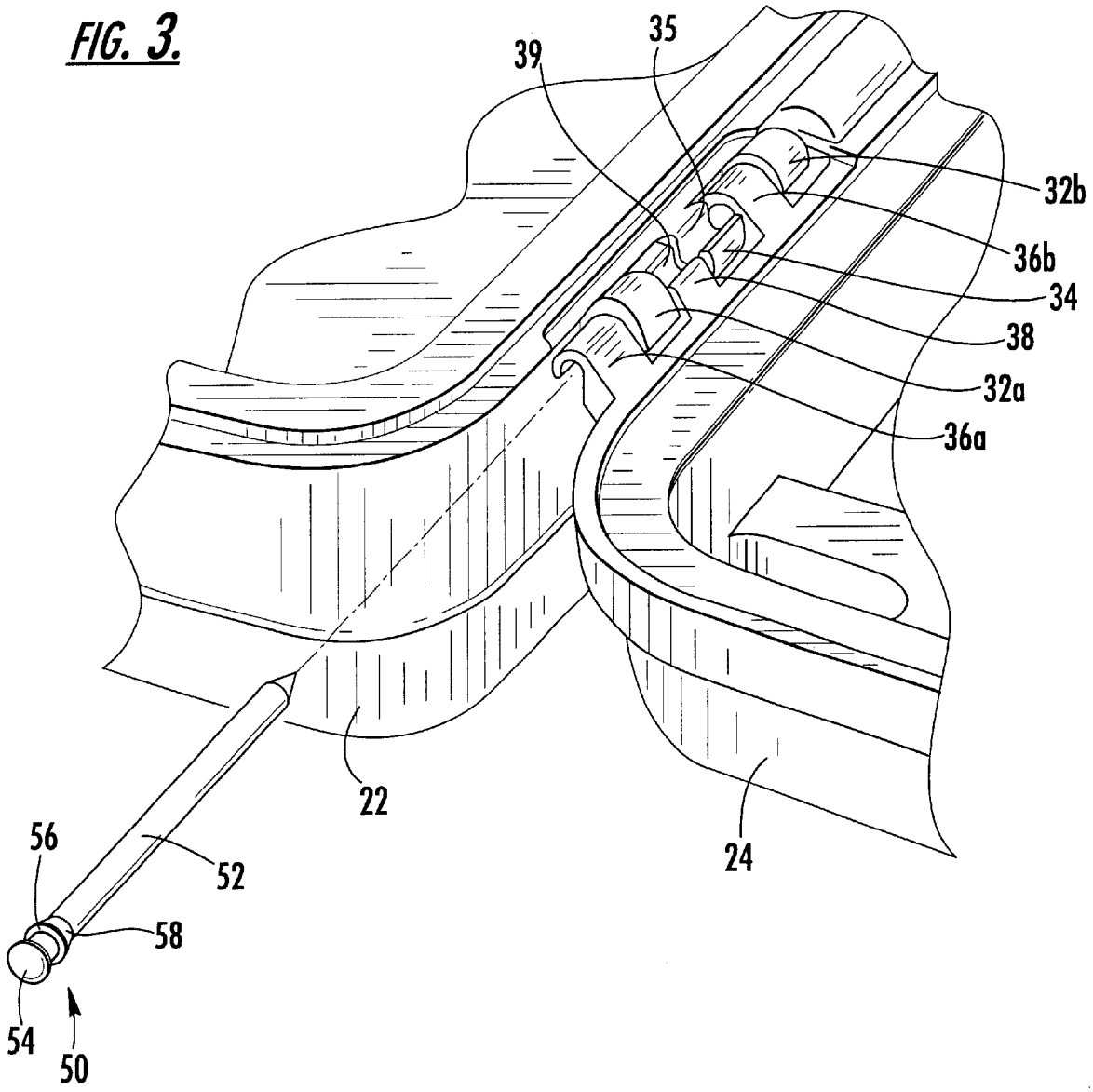
FIG. 3 is an exploded enlarged partial perspective view of the carrying case of FIG. 1 with the hinge fingers of the lid and container interdigitated and the hinge pin removed.

As a double-wall blow-molded part, the container 22 has an outer wall 22*a* and an inner wall 22*b* (FIG. 2). As is typical of double-wall blow-molded parts, the outer wall 22*a* and inner wall 22*b* are in close proximity to one another and surround an internal air-filled cavity (not shown). The container 22 may include some "pinched-off" areas (not shown) where the inner and outer walls 22*b*, 22*a* are contiguous, or the inner and outer walls 22*a*, 22*b* may meet only at the common edges thereof. As is conventional for double-wall blow-molded parts, except in the areas where the inner and outer walls 22*b*, 22*a* are contiguous, the inner and outer walls 22*b*, 22*a* are of substantially the same thickness; i.e., the walls are nominally the same thickness, and are formed from a parison having walls of substantially the same thickness, although some thinning of the walls can occur during molding, as some areas undergo more stretching than others in order to fill the mold cavity. Double-wall blow-molding is discussed generally in U.S. Pat. No. 5,685,451 to Newby, Sr., the disclosure of which is hereby incorporated herein in its entirety.

The container 22 is formed of a thermoplastic material suitable for blow-molding, preferably polyethylene having a room temperature elastic modulus of between about 80,000 and 260,000 psi at room temperature. Other suitable materials include polypropylene, polystyrene, acrylonitrile-butadiene-styrene (ABS), and copolymers thereof.

It is preferred that the cover 24 also be formed of a thermoplastic material and have a double-wall blow-molded construction as described above for the container 22. Those skilled in this art will recognize that other materials and structures may also be suitable for use in the cover 24.

The hinge 30 includes two hinge units 31*a*, 31*b*, each of which includes structures that are located on the rear walls 23, 25 of both the container 22 and the lid 24 as well as a pin 50. These structures are illustratively and preferably integrally formed with the rear walls 23, 25. The hinge units 31*a*, 31*b* are mirror images of one another about a vertical plane P that is located between and equidistant from the hinge units 31*a*, 31*b* and that bisects the lid 24 and container 22 (see FIG. 1). Because the hinge units 31*a*, 31*b* are identical, only the hinge unit 31*a* will be described in detail herein, with the understanding that the discussion is equally applicable to the hinge unit 31*b*.

Referring now to FIGS. 2 through 6, the hinge unit 31*a* includes a pair of downwardly facing fingers 32*a*, 32*b* mounted on and extending from the rear wall 23 of the container 22. Each of these fingers 32*a*, 32*b* has a respective generally semicylindrical surface 33*a*, 33*b* that faces downwardly; these surfaces 33*a*, 33*b* are aligned with each other along the axis of rotation A. An upwardly facing finger 34 is mounted to the rear wall 23 and is positioned between and spaced apart from the upwardly facing fingers 32*a*, 32*b*; the upwardly facing finger 34 has a generally semicylindrical surface 35 that faces upwardly. The semicylindrical surfaces 33*a*, 33*b* and 35 are radially aligned with each other about the axis of rotation A. As used herein, surfaces being "radially aligned" means that they are equidistant from the axis of an imaginary cylinder on which the surfaces reside.

The hinge unit 31*a* also includes a pair of downwardly facing fingers 36*a*, 36*b* that extend upwardly from the rear wall 25 of the lid 24 (for the purposes of this discussion, the fingers 36*a*, 36*b* will be defined as facing downwardly when the lid 24 is rotated to an open position (see FIG. 2); the fingers 36*a*, 36*b* face upwardly when the lid 24 is rotated to its closed position (see FIG. 2 in phantom line)). The fingers 36*a*, 36*b* include generally semicylindrical surfaces 37*a*, 37*b* that face downwardly and that are aligned with one another along the axis of rotation A. The upwardly extending finger 36*a* includes a recess 40 in the surface 37*a* (see FIGS. 4 and 5). An upwardly facing finger 38 extends upwardly from the rear wall 25 between and spaced apart from the fingers 36*a*, 36*b*; the finger 38 includes a generally semicylindrical surface 39 that faces upwardly. The semicylinindrical surfaces 37*a*, 37*b* and 39 are radially aligned about the axis of rotation A.

The hinge unit 31*a* also includes a pin 50. The pin 50 has an elongate cylindrical shaft 52 and a head 54 at one end. An intermediate head 56 is positioned near, but spaced apart from, the head 54. A tapered section 58 serves as a transition region between the perimeter of the intermediate head 56 and the shaft 52.

The pin 50 can be formed of any material that is sufficiently strong and rigid to remain in place within the hinge unit 31*a* and withstand the forces applied thereto during operation. Typically, the pin 50 is formed of a polymeric material such as nylon or acetal.

Figure 4:
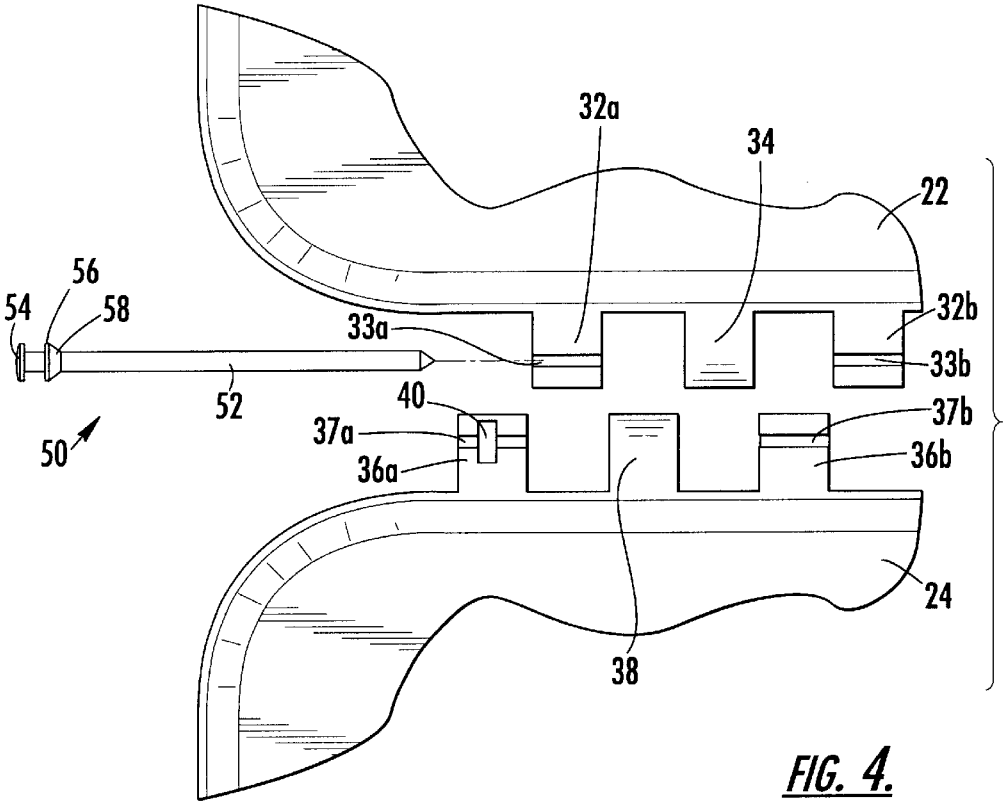
FIG. 4 is an exploded partial bottom view of the carrying case of FIG. 1 with the hinge fingers of the lid and container separated.
Figure 5:
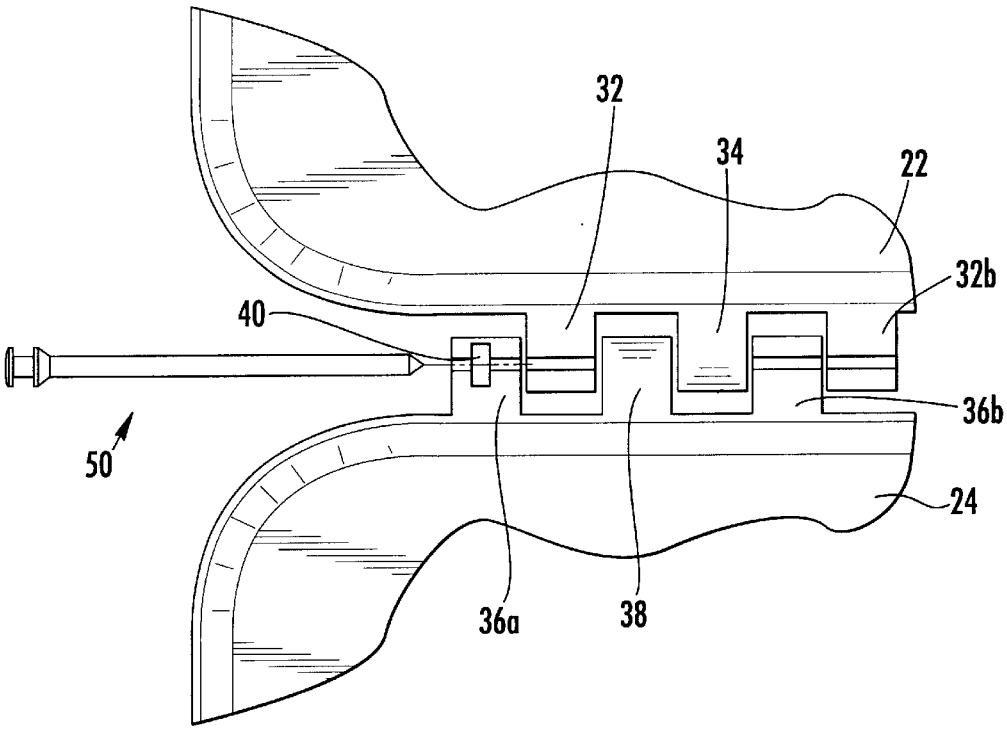
FIG. 5 is a partial bottom view of the carrying case of FIG. 1 with the hinge fingers of the lid and container interdigitated and the hinge pin removed.
Figure 6:
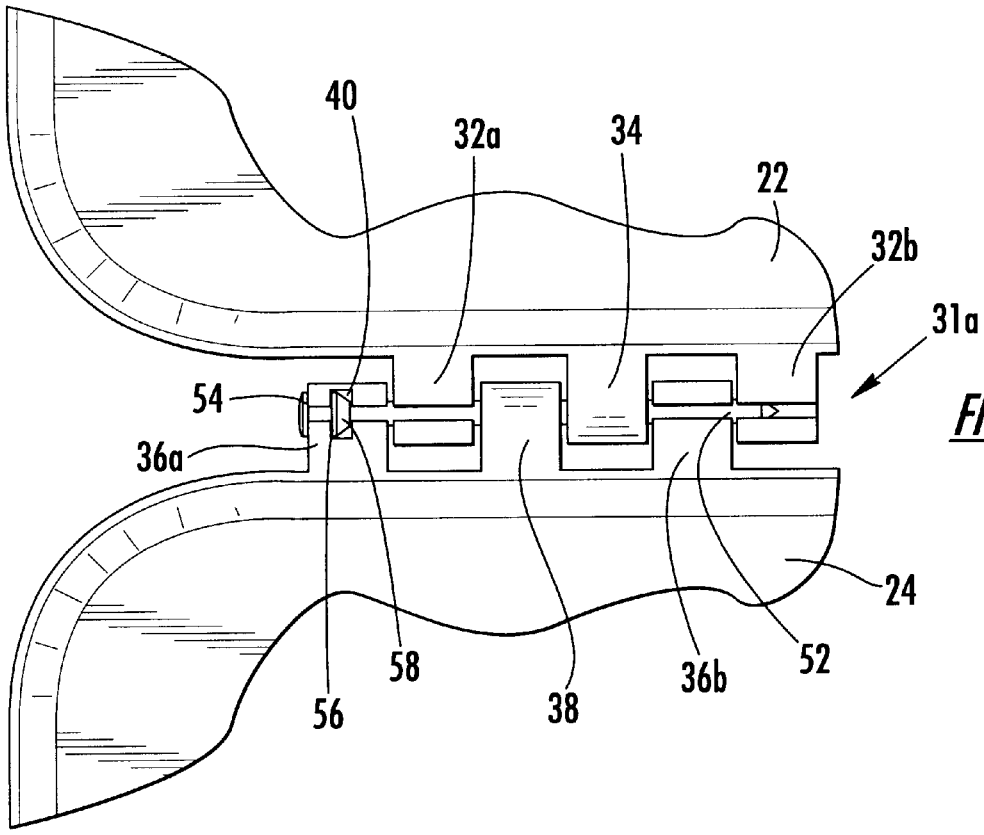
FIG. 6 is a partial bottom view of the carrying case of FIG. 2 taken along lines 6—6 therein, with the hinge fingers interdigitated and the hinge pin inserted.

The assembly and operation of the hinge unit 31*a* can be understood by reference to FIGS. 4 through 6. Starting from a separated position (FIG. 4), the container 22 and lid 24 are positioned with their rear walls 23, 25 adjacent one another such that the fingers of each mesh in an interdigitating fashion; i.e., the finger 32*a* fits in the space between the fingers 36*a* and 38, the finger 38 fits in the space between the fingers 32*a* and 34, and this interdigitation pattern of fingers continues until the finger 36*b* fits between the fingers 34 and 32*a* (see FIG. 5). Also, the fingers should be positioned such that surfaces 33*a*, 33*b*, 37*a*, 37*b* align along the axis A, and so that the surfaces 35, 39 also align along the axis of rotation A, with the result that all of these surfaces are radially aligned. Alignment of the fingers and surfaces as described forms a pin channel 42 along the axis A.

Once the lid 22 and the container 24 are positioned as described above (FIG. 5), the pin 50 is inserted into the pin channel 42. Insertion is carried out by inserting the free end of the pin 50 (i e., the end of the pin 50 located away from the head 54) into the pin channel 42 adjacent the finger 36*a*. The shaft 52 of the pin 50 is then advanced into the pin channel 42. As the tapered section 58 of the pin 50 reaches the finger 36*a*, it forces the finger 36*a* to deflect away from the rear wall 25, thereby "opening up" that end of the pin channel 42. Insertion of the pin 50 continues until the intermediate head 56 of the pin 50 reaches the recess 44 in the finger 36*a*. At this point, the finger 36*a* is free to relax to its original position, as the intermediate head 56 is sized and configured to fit within the recess 44. As such, the pin 50 is retained in the pin channel 42 and can serve as the pivot point for the hinge unit 31*a* (see FIG. 6).

Notably, each of the container 22 and the lid 24 includes both fingers that face upwardly and fingers that face downwardly. As a result, the fingers of the container 22 and lid 24 have the capacity alone to capture and retain the pin 50 and constrain it from movement in a direction normal to the axis A. Accordingly, when the fingers of the container 22 and lid 24 are interdigitated to form the pin channel 42, the pin 50 can be retained therein irrespective of the relative rotative positions of the lid 24 and container 22 about the axis of rotation A. It should be noted that it is not necessary that all of the finger surfaces be generally semicylindrical; however, they should be partially cylindrical (i.e., they should define some portion of a cylinder) to permit rotation about the pin 50.

In this configuration, the hinge unit 31*a* is a pinned hinge configuration that provides the performance benefits ordinarily associated with pinned hinge designs. In addition, the interaction between the intermediate head of the pin 50 and the recess 44 of the finger 36*a* retains the pin 50 within the pin channel 42. As such, there is no need for the fingers and pin 50 to form an interference fit to retain the pin 50. Further, only the finger 36*a* experiences any hoop stress due to the pin 50, and that hoop stress is typically experienced only during insertion. It is preferred, but not essential, that it be an endmost finger (e.g., the finger 36*a*) that includes the recess 44, but any other finger could also have a recess and still be suitable for the present invention with an appropriately designed pin and intermediate head.

In addition, the pinned hinge configuration of the present invention can be formed without the need for side-action mechanisms, pin inserts in the mold, or post-molding drilling operations. With this configuration, the hinge fingers and partially cylindrical surfaces can be formed with simple reciprocation of the mold halves, thereby eliminating the need for side-action mechanisms, inserts or post-molding drilling to form the structures that capture the pin. The absence of side-action mechanisms can decrease mold cost and reduce mold maintenance; the absence of pin inserts or post-molding operations can simplify manufacturing.

The hinge unit 31*b* is configured and assembled in a minor image fashion, so its structure, assembly and operation need not be discussed in detail herein. Those skilled in this art will recognize that, although two hinge units 31*a*, 31*b* are illustrated herein, the hinge configuration is suitable for use with a single hinge unit or multiple hinge units. Also, the hinge unit can be used in conjunction with another hinge configuration, such as that illustrated in U.S. Pat. No. 5,361,456 to Newby, Sr., positioned along the axis of rotation A. Notably, this configuration can be used with different styles of hinge configurations, whether they employ a post/receptacle configuration such as that illustrated in U.S. Pat. No. 5,361,456 to Newby, Sr. that is assembled after molding or a pin insert design such as that illustrated in U.S. Pat. No. 5,288,453 to Rutenbeck et al., as the present hinge configuration can be assembled whether the parts are molded assembled or unassembled.

Those skilled in this art will also understand that, although the hinge units 31*a*, 31*b* are illustrated for use with a carrying case, other hinged members, such as hinged panels and the like, can also be used with the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A hinge configuration, comprising:

a first member formed of a polymeric material having a plurality of hinge fingers with partially cylindrical surfaces with opposed open ends, at least one of said surfaces of said first member hinge fingers being generally upwardly facing and at least one of said surfaces of said first member hinge fingers being generally downwardly facing, said hinge fingers of said first member being spaced apart along an axis of rotation and said partially cylindrical surfaces of said first member hinge fingers being radially aligned along said axis of rotation;

a second member formed of a polymeric material having a plurality of hinge fingers with partially cylindrical surfaces with opposed open ends, at least one of said surfaces of said second member hinge fingers being generally upwardly facing and at least one of said surfaces of said second member hinge fingers being generally downwardly facing, said hinge fingers of said second member being spaced apart along an axis of rotation and said partially cylindrical surfaces of said second member hinge fingers being radially aligned along said axis of rotation; and a pin including a shaft extending along said axis of rotation, an end head at one end of said shaft, and an intermediate head spaced apart from said head and extending radially from said shaft, said shaft being in contact with and rotatable relative to said partially cylindrical surfaces of said hinge fingers of said first and second members;

one of said surfaces of said first member hinge fingers or said second member hinge fingers including a recess that captures said intermediate head of said pin and prevents movement of said pin along said axis of rotation irrespective of the relative rotative positions of said first and second members.

2. The hinge configuration defined in claim 1, wherein said recess is included in a partially cylindrical surface of an endmost one of said hinge fingers, and wherein said end head is positioned adjacent said endmost hinge finger.

3. The hinge configuration defined in claim 1, wherein said hinge fingers of said first member and said hinge fingers of said second member are interdigitated.

4. The hinge configuration defined in claim 1, wherein said pin includes a tapered section extending from said intermediate head away from said end head.

5. The hinge configuration defined in claim 1, wherein said hinge fingers of said first member are integrally formed with said first member, and wherein said hinge fingers of said second member are integrally formed with said second member.

6. The hinge configuration defined in claim 5, wherein said first and second members are double-wall blow-molded members.

7. A hinged carrying case, comprising:

a double-wall blow-molded container having inner and outer walls enclosing a cavity;

a double-wall blow-molded lid having inner and outer walls enclosing a cavity;

said container including a plurality of hinge fingers with partially cylindrical surfaces with opposed open ends, said hinge fingers being attached to said container outer wall, at least one of said surfaces of said container hinge fingers being generally upwardly facing and at least one of said surfaces of said container hinge fingers being generally downwardly facing, said hinge fingers of said container being spaced apart along an axis of rotation and said partially cylindrical surfaces of said container hinge fingers being radially aligned along said axis of rotation;

said lid including a plurality of hinge fingers with partially cylindrical surfaces with opposed open ends, said hinge fingers being attached to said lid outer wall, at least one of said surfaces of said lid hinge fingers being generally upwardly facing and at least one of said surfaces of said lid hinge fingers being generally downwardly facing, said hinge fingers of said lid member being spaced apart along said axis of rotation and said partially cylindrical surfaces of said lid hinge fingers being radially aligned said axis of rotation; and a pin including a shaft extending along said axis of rotation, an end head at one end of said shaft, and an intermediate head spaced apart from said head and extending radially from said shaft, said shaft being in contact with and rotatable relative to said partially cylindrical surfaces of said hinge fingers of said container and said lid;

one of said surfaces of said container hinge fingers or said lid hinge fingers including a recess that captures said intermediate head of said pin and prevents movement of said pin along said axis of rotation irrespective of the relative rotative positions of said first and second members.

8. The carrying case defined in claim 7, wherein said recess is included in a partially cylindrical surface of an endmost one of said hinge fingers, and wherein said end head is positioned adjacent said endmost hinge finger.

9. The carrying case defined in claim 7, wherein said hinge fingers of said container and said hinge fingers of said lid member are interdigitated.

10. The carrying case defined in claim 7, wherein said pin includes a tapered section extending from said intermediate head away from said end head.

11. The carrying case defined in claim 7, further comprising a second hinge unit located on said pivot axis.

12. The carrying case defined in claim 7, wherein said container and said lid are formed of polyethylene.

13. The carrying case defined in claim 7, wherein said inner and outer walls of said container are of substantially the same thickness.

14. The carrying case defined in claim 7, wherein said inner and outer walls of said lid are of substantially the same thickness.

15. A method of forming a hinged article, comprising the steps of:

providing a first member having a plurality of hinge fingers with partially cylindrical surfaces with opposed open ends, at least one of said surfaces of said first member hinge fingers being generally upwardly facing and at least one of said surfaces of said first member hinge fingers being generally downwardly facing, said hinge fingers of said first member being spaced apart along a first axis of rotation and said partially cylindrical surfaces of said first member hinge fingers being radially aligned along said first axis of rotation;

providing a second member having a plurality of hinge fingers with partially cylindrical surfaces with opposed open ends, at least one of said surfaces of said second member hinge fingers being generally upwardly facing and at least one of said surfaces of said second member hinge fingers being generally downwardly facing, said hinge fingers of said second member being spaced apart along a second axis of rotation and said partially cylindrical surfaces of said second member hinge fingers being radially aligned along said second axis of rotation;

wherein one of said surfaces of said first member hinge fingers or said second member hinge fingers includes a recess;

providing a pin including a shaft extending along said axis of rotation, an end head at one end of said shaft, and an intermediate head spaced apart from said head and extending radially from said shaft;

positioning said first and second members such that said first and second axes of rotation are coincident and such that said surfaces of said first and second members form a pin channel; and advancing said pin into said pin channel such that said shaft is in contact with and rotatable relative to said partially cylindrical surfaces of said hinge fingers of said first and second members and such that said intermediate head of said pin is captured in said recess and prevents movement of said pin along said axis of rotation irrespective of the relative rotative positions of said first and second members.

16. The method defined in claim 15, wherein said providing steps comprising blow-molding said first and second members with first and second molds.

17. The method defined in claim 16, wherein said first and second molds lack side action mechanisms for forming said hinge fingers of said first and second members.

* * * * *